United States Patent [19]

Holton et al.

[11] 4,036,680

[45] July 19, 1977

[54] DELIGNIFICATION OF LIGNOCELLULOSIC MATERIAL WITH A SODA PULPING LIQUOR CONTAINING A DIELS ALDER ADDUCT OF BENZOQUINONE OR NAPHTHOQUINONE IN ADMIXTURE WITH A NITRO AROMATIC COMPOUND

[75] Inventors: Harry Hutchinson Holton, Beloeil; Gordon Hart Segall, Mont St.Hilaire, both of Canada

[73] Assignee: Canadian Industries, Ltd., Montreal, Canada

[21] Appl. No.: 750,442

[22] Filed: Dec. 14, 1976

[51] Int. Cl.[2] ..... D21C 3/20; D21C 9/10

[52] U.S. Cl. ..... 162/65; 8/111; 162/72; 162/76; 162/77; 162/90

[58] Field of Search ..... 162/65, 70, 72, 76, 162/77, 90; 8/107, 111; 260/515 R, 578, 599, 622 R, 622 P, 645, 369

[56] References Cited

U.S. PATENT DOCUMENTS

| | | | |
|---|---|---|---|
| 2,538,457 | 1/1951 | Hudson | 162/72 X |
| 4,012,280 | 3/1977 | Holton | 162/65 |

FOREIGN PATENT DOCUMENTS

| | | | |
|---|---|---|---|
| 43,403 | 4/1976 | Japan | 162/72 |

*Primary Examiner*—Arthur L. Corbin
*Attorney, Agent, or Firm*—Guy Drouin

[57] ABSTRACT

Delignification of lignocellulosic material, such as wood, straw or bagasse, with a soda pulping liquor containing a diketo hydroanthracene selected from the unsubstituted and lower alkyl-substituted Diels Alder adducts of naphthoquinone and benzoquinone and a nitro aromatic compound selected from mono and dinitrobenzenes and the amino, carboxy, hydroxy and methyl derivatives of said nitrobenzenes.

8 Claims, No Drawings

DELIGNIFICATION OF LIGNOCELLULOSIC MATERIAL WITH A SODA PULPING LIQUOR CONTAINING A DIELS ALDER ADDUCT OF BENZOQUINONE OR NAPHTHOQUINONE IN ADMIXTURE WITH A NITRO AROMATIC COMPOUND

This invention relates to a process for the delignification of lignocellulosic material such as wood, straw, bagasse, etc.

The processing of lignocellulosic material to produce cellulose suitable for the manufacture of paper products involves the removal of lignin and other non-cellulosic components such as gums. Reagents that attack lignin without affecting appreciably the cellulose component are preferred for this purpose. In the sulphate or kraft process, lignocellulosic material is cooked with a mixture of sodium hydroxide and sodium sulphide. In the soda process the cooking is carried out with sodium hydroxide alone. In Canadian Pat. No. 895,756, issued on Mar. 21, 1972 to H. E. Worster and M. F. Pudek, there is described a two stage soda-oxygen pulping process comprising a first stage sodium hydroxide digestion, followed by defiberization of the product of the sodium hydroxide digestion, and a second stage digestion with sodium hydroxide in the presence of excess oxygen. This process produces pulp in yield comparable to the yield of a conventional kraft process. Although these processes are effective in the removal of lignin from lignocellulosic material such as wood, the cellulose component of the material is attacked also to a certain degree, resulting in a lowering of yields and degradation of the product.

The contribution to air pollution of volatile mercaptans and hydrogen sulphide is a serious disadvantage of the kraft process. The soda process is superior in this respect; however, the soda process is unsuitable for pulping coniferous woods because of long cooking times and low yields. Even in the case of hardwoods, yields are inferior to those achieved using the kraft process. A recent publication (B. Bach and G. Fiehn, Zellstoff Papier 21, No. 1,3-7, January 1972) and a related East German Pat. No. 98,549 of June 20, 1973 disclose the use of anthraquinone2-monosulphonic acid (AMS) as a means of improving yields in the soda process. More recently, U.S. Pat. No. 3,888,727) this additive was employed in the first stage of a soda-oxygen process, resulting in yields superior to those of a conventional kraft process; the pulp possessed strength properties comparable to kraft. Unfortunately, the soda-AMS pulping process does not eliminate the odour problem, since sulphur derived from the additive is converted to sulphide in the pulping chemicals recovery systems and thence to mercaptans or hydrogen sulphide during the next cooking cycle. The economic advantages resulting from higher yields are largely offset by the relatively high cost of AMS. Other derivatives previously evaluated in soda cooking (Bach and Fiehn, above), not containing sulphur, were substantially less effective than AMS.

In U.S. patent application Ser. No. 718,980 filed on Aug. 30, 1976, now U.S. Pat. No 4,012,280, it is proposed to use, instead of AMS as an additive in the soda process, a sulphurfree cyclic keto compound such as, among others, naphthoquinone, anthraquinone, anthrone phenanthrenequinone and the alkyl, alkoxy and amino derivatives of said quinones. Compared to AMS, these quinone additives have the very great advantages that they do not contribute to pollution and that for a given concentration and under comparable pulping conditions, they are more effective.

The Pulp and Paper Research Institute of Canada has reported [Sv. Pappers. 71 (23) 857-863 (1968)] the effects of several nitro aromatic compounds in accelerating and improving the yields from the soda pulping of softwood. While not the most effective, nitrobenzene is identified in this publication as the only additive of commercial significance. Large amounts of nitrobenzene are used (1-10%) resulting in yields equivalent to that of the kraft process. However, the process is not felt to be commercially practicable due to severe deficiencies in cooking time and poor strength properties when compared to the kraft process.

It has now been found that lignocellulosic material can be delignified in higher yield than heretofore attained by a process which comprises a digestion with a soda pulping liquor in the presence of a Diels Alder adduct of napthoquinone or benzoquinone together with a nitro aromatic compound. Optionally, the digestion with the soda pulping liquor may be followed by a second stage digestion in alkaline medium with oxygen or an oxygen-containing gas under pressure. Compared to the above prior processes wherein a cyclic keto compound or an aromatic nitro compound is used alone as an additive, the novel process provides a pulp in a much higher yield at a given kappa number with a comparable rate of delignification and comparable strength properties. When used in combination with Diels Alder adducts as in the novel process of this invention, nitro aromatic compounds have been found to exert negligible negative effects on pulp properties (viscosity) and key paper making parameters whereas when used alone, they are not commercially practicable as is indicated in the above publication of the The Pulp and Paper Research Institute of Canada.

Thus the main object of the invention is to provide a soda pulping process for the efficient digestion of softwood. Another object is to provide a soda pulping process that gives an increased yield of cellulosic pulp as compared to that of the kraft process. A further object is to provide a pulping process that has a low pollution potential. Additional objects will appear hereinafter.

The process of the invention comprises the steps of 1. treating lignocellulosic material in a closed reaction vessel with a pulping liquor containing alkali metal base and, as additives, from 0.001 to 10.0% by weight, based on the lignocellulosic material, of a diketo hydroanthracene selected from the unsubstituted and the lower alkyl-substituted Diels Alder adducts of naphthoquinone and benzoquinone, and from 0.01 to 10.0% by weight, based on the lignocellulosic material, of a nitro aromatic compound selected from the group consisting of mono- and di-nitrobenzenes and the amino, carboxy, hydroxy and methyl derivatives of said nitrobenzenes, the treatment taking place at a maximum temperature in the range of 150° to 200° C. for a period of 0.5- 480 minutes, and 2. displacing the pulping liquor from the lignocellulosic material with water or an aqueous liquor inert to the lignocellulosic material to obtain delignified lignocellulosic material.

The delignified lignocellulosic material produced by the above two steps may be used without further treatment or may be subjected to conventional bleaching steps.

Optionally, the delignified lignocellulosic material may be subjected to the following additional treatment steps:

3. treatment of the delignified lignocellulosic material in aqueous suspension at a consistency of 2 to 40% by weight for 0.5 to 60 minutes at 20° to 90° C. with 2 to 20% by weight of an alkali metal base, and 4. treatment of the alkaline material in aqueous medium at a consistency of from 3 to 40% by weight with oxygen or an oxygen-containing gas for 0.5 to 120 minutes at a temperature of 80° to 150° C. and a partial pressure of oxygen of 20 to 200 pounds per square inch.

When the lignocellulosic material employed is wood, this is first converted into the form of chips. This step will not be required when the lignocellulosic material is of fibrous form.

The lignocellulosic material may be refined between steps (1) and (2) or between steps (2) and (3). Refining can be carried out with known equipment such as a single disc or double disc refiner.

The process of this invention can be used to delignify either coniferous or deciduous species of wood. By coniferous is meant species such as pine, spruce and balsam fir. By deciduous is meant species such as birch, aspen, eastern cottonwood, maple, beech and oak. When employed with a high density deciduous wood such as birch, it is preferable to employ a longer time to reach maximum cooking temperature in the first step. In spite of this, however, the overall cooling time is still greatly reduced in comparison with that of the conventional soda process. In the case of high density deciduous wood, it is also preferable that the alkali base added in the optional third step be so added while the pulp is at a low consistency, e.g. 2 to 6%.

The soda liquor employed in the first step of the process contains from 8 to 20% by weight of alkali metal base expressed as percent effective alkali, based on the weight of the lignocellulosic material, and normally also contains alkali metal carbonate.

Since the first step treatment of the process is carried out in a closed reaction vessel at a temperature in the range of from 150° to 200° C. in the presence of water, the reaction will take place under supra atmospheric pressure.

As mentioned above, the compounds which are suitable for use as additives in the process of the invention in combination with the nitro aromatic compounds are diketo hydroanthracenes selected from the group consisting of the unsubstituted and lower alkyl-substituted Diels Alder adducts of naphthoquinone and benzoquinone. The compounds, which are not quinones, have surprisingly been found to afford pulping results at least as good as, and when used in combination with nitro aromatic compounds much better than those obtained with the quinones of the above-identified patent application.

More particularly, the unsubstituted Diels Alder adducts are those obtained by reacting 1 or 2 moles of butadiene with naphthoquinone and benzoquinone respectively and the lower alkyl-substituted adducts are those obtained where, in the above reaction, either one or both of the reactants are substituted with the appropriate lower alkyl groups. The alkyl groups in the lower alkyl-substituted Diels Alder adducts may range from 1 to 4 in number, may each contain from 1 to 4 carbon atoms and may be the same or different. Examples of the above defined diketo hydroanthracenes are 1,4,4a, 9a-tetrahydro-9,10-diketo anthracene, 2-ethyl-1,4,4a9a-tetrahydro-9,10-diketo anthracene, 2,3-dimethyl-1,4,4a, 9a-tetrahydro-9,10-diketo anthracene, 1,3-diemthyl-1,4,4a, 9a-tetrahydro-9,10-diketo anthracene, 1,4,4a, 5,8,8a, 9a, 10a-octahydro-9,10-diketo anthracene, 2,3,6,7-tetramethyl-1,4,4a, 5,8,8a, 9a, 10a-octahydro-9,10-diketo anthracene and a mixture of 2,6 and 2,7-diethyl-1,4,4a,5,8,8a, 9a, 10a-octahydro-9,10-diketo antracene. The diketo hydroanthracene additive is employed in proportions of from 0.001 to 10.0%, preferably 0.01 to 1.0%, by weight based on the lignocellulosic material.

As is also mentioned above, the nitro aromatic compounds which are suitable for use as additives in the process of the invention in combination with the diketo anthracenes are selected from the group consisting of monoand dinitrobenzenes and the amino, carboxy, hydroxy and methyl derivatives of said nitrobenzenes. Examples of these compounds are nitrobenzene, 2-nitroaniline, 4-nitroaniline, 4-nitrobenzaldehyde, 4-nitrobenzoic acid, 2-nitroresorcinol, 4-nitrostyrene, 2-nitrotoluene, 4-nitrotoluene, 1,2-dinitrobenzene, 1,3-dinitrobenzene, 1,4-dinitrobenzene, 2,4-dinitrotoluene, 3,5-dinitrobenzoic acid, 4,6-dinitro-o-cresol and 2,4-dinitroresorcinol. Among the above compounds, nitrobenzene is particularly preferred because of its favourable cost:benefit ratio. The nitro aromatic compound is employed in proportions of from 0.01 to 10.0%, preferably 0.10 to 2.0%, by weight based on the lignocellulosic material.

It is understood that all the combinations of additives formed from any one of the above defined diketo anthracenes with any one of the above defined nitro aromatic compounds are suitable for use in the process of the invention. Preferred, however, are the combinations comprised of nitrobenzene with any one of the diketo hydroanthracenes selected from 1,4,4a, 9a,-tetrahydro-9,10-diketo anthracene, 2-ethyl-1,4,4a 9a-tetrahydro-9,10-diekto anthracene, 2,3-dimethyl-1,4,4a, 9a-tetrahydro-9,10-diketo anthracene, 1,3-dimethyl-1,4,4a, 9a-tetrahydro-9,10-diketo anthracene, 1,4,4a, 5,8,8a, 9a, 10a-octahydro-9,10-diketo anthracene and 2,3,6,7-tetramethyl-1,4,4a 5,8,8a-9a, 10a-octahydro-9,10-diketo anthracene. Especially preferred are the combinations of nitrobenzene with 1,4,4a-9a-tetrahydro-9,10-diketo anthracene or 1,4,4a, 5,8,8a, 9a, 10a-octahydro-9,10-diketo anthracene.

After the first step treatment with pulping liquor, the resulting pulp yield will be 40 to 70%, by weight, based on the lignocellulosic material. The kappa number of the material at completion of the first step will lie in the range 10 to 150 for coniferous woods and in the range 5 to 100 for deciduous woods.

The partially delignified material resulting from the first treatment step is discharged from the pulping vessel and the spent liquor displaced by fresh water or optionally by an aqueous liquior inert to lignocellulosic material such as the spent liquor from the alkaline oxygen treatment step or "white water" from a later stage of a papermaking process.

Optionally, the delignified lignocellulosic material may then be subjected to an alkaline oxygen treatment. To the material is added alkali metal base. The alkali metal base may be provided in the form of pulping liquor such as used in the first step of the process. This liquor therefore may contain carbonate in addition to alkali metal base. Preferably, there is also added 0.1 to 1.0%, by weight of the pulp, of a magnesium salt such as magnesium chloride or magnesium sulphate calculated as magnesium ion. The magnesium salt may be added directly as the salt or as a complex formed with the spent liquor from the alkaline oxygen treatment step.

The alkaline treated material is then fed into an oxygen treatment vessel. The material is then treated with oxygen of an oxygen-containing gas under a partial pressure of oxygen of from 20 to 200 pounds per square inch. The product of the oxygen treatment is separated from the spent liquor and washed with water. It will have a residual lignin content of 1 to 6%, preferably 1.5 to 4.5% of the weight of the original cellulosic material corresponding to a yield of 80 to 98% by weight.

The alkali metal base employed as reagent in the process of this invention may be sodium hydroxide, potassium hydroxide, sodium carbonate or potassium carbonate.

The material resulting from step (2) may be bleached by any conventional bleaching process. A conventional sequence comprising chlorination, alkaline extraction, chlorine dioxide treatment, alkaline extraction, chlorine dioxide treatment (C-E-D-E-D) when applied to the material resulting from step (2), will provide a product having a brightness of approximately 85–90 units (Elrepho). The material resulting from step (4) may be bleached by the sequence chlorination, alkaline extraction, chlorine dioxide treatment (C-E-D) or any other conventional sequence. When applied to the material resulting from step (4), the sequence C-E-D will provide a product having a brightness of approximately 85–90 units (Elrepho).

The process of this invention has the advantage that the absence of sulphur-containing reagents results in lessened pollution potential as compared to the process of East German Pat. No. 98,549. The process also provides a pulp in much higher yield at a given kappa number, than has been heretofore attainable by any of the prior art pulping processes mentioned hereinabove.

The invention is illustrated by the following examples but its scope is not limited to the embodiment shown therein.

In the Examples, kappa number and viscosity determinations were carried out by the following methods.

Kappa Number: TAPPI Method T-236 M-60

Viscosity: TAPPI Method T-230 SU-66

In all the following Examples, pulping was carried out in stainless steel pressure vessels of either one of the following two types; (1) a set of three such vessels each containing a rotatable horizontal basket, and (2) an assembly of eight such vessels (hereinafter called the microdigester assembly) each of which is itself horizontally rotatable. Large size samples of chips of 300, 600 or 2400 grams (oven dried weight) were pulped in any one of the three vessels of the first type while small size samples of 75 grams were pulped eight at a time in the second type of vessels, i.e. in the microdigester assembly. The chips were dried to approximately 90% consistency divided into appropriate portions in consideration of the number and size of the pulping runs to be carried out and stored at 4° C. Exact amounts of chips of accurately known consistency were weighed out and soaked 24 hours in water prior to pulping. Soaked chips were placed inside the pressure vessel and optionally presteamed for 10 minutes. Pulping liquor and dilution water were then added in the amounts required to give the desired effective alkali and to obtain a liquor to wood ratio of 4:1. Indirect electrical heating was used in both types of vessels. In the case of the microdigester assembly water under pressure was employed as a heat transfer medium. Heating was controlled to linearly raise the temperature to a preset maximum in a given time and to maintain it within ± 2° C. of said maximum to the end of the cooking period.

After completion of the cooking, the pressure was released and the pulp together with the used cooking liquor was transferred to a mixer such as a Cowless dissolver, diluted to 2% consistency and stirred for 5 minutes to simulate the blowdown of pulp that occurs in a commercial scale digester. The pulp was then washed twice by dilution to 2% consistency with water and filtered and pressed to 25% consistency. The pulp was then crumbed in a Hobart mixer, weighed and samples were taken for yield, kappa number and viscosity measurements.

EXAMPLE 1

Twenty samples of black spruce chips were subjected to pulping treatment employing soda pulping liquor containing combinations of a diketo hydroanthracene and nitro aromatic compounds according to the invention as additives, or soda pulping liquor containing a diketo hydroanthracene as additive but no nitro aromatic compounds. Cooking with pulping liquor was carried out using the digester and procedure described immediately above. In all the runs, the soda liquor had an effective alkalinity of 15.5%, was heated to a maximum temperature of 170° C. in 90 minutes and maintained at this temperature for 80 minutes. The pulping results obtained are shown in Table I.

TABLE I

SODA PULPING RESULTS

| Run No. | Additive 1 | % on wood | Additive 2 | % on wood | Results without Additive 2 | | | Results with Additive 2 | | |
|---|---|---|---|---|---|---|---|---|---|---|
| | | | | | Kappa No. | Yield % | Viscosity cps | Kappa No. | Yield % | Viscosity cps |
| 1 | 1,4,4a,5,8,8a,9a,-10a-OCTAHYDRO-9,10-DIKETO ANTHRACENE | 0.25 | NITROBENZENE | 0.25 | 37.1 | 50.4 | 27.1 | 36.8 | 51.0 | 20.7 |
| 2 | " | 0.25 | " | 0.50 | 37.1 | 50.4 | 27.1 | 37.1 | 52.7 | 22.3 |
| 3 | " | 0.25 | " | 0.75 | 37.1 | 50.4 | 27.1 | 35.8 | 52.8 | 20.5 |
| 4 | " | 0.25 | " | 1.0 | 37.1 | 50.4 | 27.1 | 36.9 | 53.5 | 19.9 |
| 5 | MIXTURE OF 2,6- and 2,7-DIETHYL-1,4,4a,5,8,8a,9a,10a-OCTAHYDRO-9,10-DIKETO ANTHRACENE | 0.25 | " | 1.0 | 42.0 | 52.5 | — | 45.9 | 53.6 | — |
| 6 | 1,4,4a,5,8,8a,9a,10a-OCTAHYDRO-9,10-DIKETO ANTHRACENE | 0.25 | 2-NITROTOLUENE | 1.0 | 39.8 | 51.3 | — | 41.0 | 53.0 | — |
| 7 | " | 0.25 | 4-NITRO- | 1.0 | 39.8 | 51.3 | — | 36.1 | 53.5 | — |

TABLE I-continued

| Run No. | Additive 1 | % on wood | Additive 2 | % on wood | Results without Additive 2 Kappa No. | Yield % | Viscosity cps | Results with Additive 2 Kappa No. | Yield % | Viscosity cps |
|---|---|---|---|---|---|---|---|---|---|---|
| | | | SODA PULPING RESULTS | | | | | | | |
| 8 | " | 0.25 | BENZALDEHYDE 4-NITRO-TOLUENE | 1.0 | 34.7 | 50.2 | — | 40.2 | 53.4 | — |
| 9 | " | 0.25 | 4,6-DINITRO-O-CRESOL | 1.0 | 34.7 | 50.2 | — | 38.3 | 52.2 | — |
| 10 | 1,4,4a,5,8,8a,9a,10a-OCTAHYDRO-9,10-DIKETO ANTHRACENE | 0.25 | M-DINITRO-BENZENE | 1.0 | 34.7 | 50.2 | — | 41.7 | 52.7 | — |
| 11 | " | 0.25 | 4-NITROBENZ-OIC ACID | 1.0 | 34.7 | 50.2 | — | 37.8 | 52.6 | — |
| 12 | " | 0.25 | 2-NITRO-ANILINE | 1.0 | 34.7 | 50.2 | — | 38.9 | 53.6 | — |
| 13 | " | 0.25 | 4-NITRO-ANILINE | 1.0 | 34.7 | 50.2 | — | 39.2 | 54.7 | — |
| 14 | " | 0.25 | O-DINITRO-BENZENE | 1.0 | 40.6 | 50.9 | — | 40.4 | 51.2 | — |
| 15 | " | 0.25 | P-DINITRO-BENZENE | 1.0 | 40.6 | 50.9 | — | 42.3 | 52.6 | — |
| 16 | " | 0.25 | 4-NITRO-STYRENE | 1.0 | 40.6 | 50.9 | — | 41.5 | 52.6 | — |
| 17 | " | 0.25 | 2,4-DINITRO-TOLUENE | 1.0 | 40.6 | 50.9 | — | 40.9 | 51.6 | — |
| 18 | 1,4,4a,5,8,8a,9a,10a-OCTAHYDRO-9,10-DIKETO ANTHRACENE | 0.25 | 3,5-DINITRO-BENZOIC ACID | 1.0 | 40.6 | 50.9 | — | 38.5 | 53.1 | — |
| 19 | " | 0.25 | 2-NITRO-RESORCINOL | 1.0 | 40.6 | 50.9 | — | 42.1 | 53.6 | — |
| 20 | " | 0.25 | 2,4-DINITRO-RESORCINOL | 1.0 | 40.6 | 50.9 | — | 41.8 | 53.9 | — |

EXAMPLE 2

A sample of mixed chips from a variety of hardwood species was subjected to pulping treatment employing soda pulping liquor containing a combination of 1,4,4a 5,8,8a, 9a, 10a-octahydro-9,10-diketo anthracene and nitrobenzene as additives, or soda pulping liquor containing said diketo hydroanthracene but no nitrobenzene. Cooking with pulping liquor was carried out using the same digester and procedure as in Example 1. The liquor has an effective alkalinity of 14.0%, was heated to a maximum temperature of 165° C. in 120 minutes and maintained at this temperature for 150 minutes. The pulping results obtained are shown in Table II.

EXAMPLE 3

Three samples of black spruce chips were subjected to pulping treatment employing soda pulping liquor containing combinations of a diketo hydroanthracene and nitrobenzene according to the invention as additives, or soda pulping liquor containing nitrobenzene as additive but no diketo anthracene. Cooking with pulping liquor was carried out using the same digester and procedure as in Example 1. In all the runs, the soda liquor has an effective alkalinity of 15.5%, was heated to a maximum temperature of 170° C., in 90 minutes and maintained at this temperature for 80 minutes. The pulping results obtained are shown in Table III.

TABLE II

| Additive No. 1 | % on wood | Additive No. 2 | % on wood | Results without Additive No. 2 Kappa No. | Yield % | Viscosity cps | Results with Additive No. 2 Kappa No. | Yield % | Viscosity cps |
|---|---|---|---|---|---|---|---|---|---|
| | | HARWOODS - SODA PULPING RESULTS | | | | | | | |
| 1,4,4a,5,8,8a,9a-10a-OCTAHYDRO-9,10-DIKETO ANTHRACENE | 0.10 | NITRO-BENZENE | 1.0 | 24.0 | 52.1 | — | 18.7 | 54.6 | — |

TABLE III

| Run No. | Additive No. 1 | % on wood | Additive No. 2 | % on wood | Results without Additive No. 1 Kappa No. | Yield % | Viscosity cps | Results with Additive No. 1 Kappa No. | Yield % | Viscosity cps |
|---|---|---|---|---|---|---|---|---|---|---|
| | | | SODA PULPING RESULTS | | | | | | | |
| 1 | 2-ETHYL-1,4,4a,9a-TETRHYDRO-9,10-DIKETO ANTHRACENE | 0.25 | NITROBENZENE | 1.0 | 97.6 | 58.3 | — | 39.8 | 55.3 | 24.3 |
| 2 | 2,3-DIMETHYL-1,4,4a,9a-TETRA-HYDRO-9,10-DIKETO ANTHRACENE | 0.25 | " | 1.0 | 97.6 | 58.3 | — | 40.8 | 54.8 | 21.4 |
| 3 | 1,3-DIMETHYL-1,4,4a,9a,-TETRA- | 0.25 | " | 1.0 | 97.6 | 58.3 | — | 44.7 | 54.4 | 22.5 |

TABLE III-continued

| Run No. | Additive No. 1 | % on wood | Additive No. 2 | % on wood | Results without Additive No. 1 Kappa No. | Yield % | Viscosity cps | Results with Additive No. 1 Kappa No. | Yield % | Viscosity cps |
|---|---|---|---|---|---|---|---|---|---|---|
| | HYDRO-9,10-DI-KETO ANTHRACENE | | | | | | | | | |

EXAMPLE 4

Two samples of black spruce chips were subjected to pulping treatment using the same digester and procedure as in Example 1. In run 1 a soda liquor was used containing no additive while in run 2 a soda liquor was also used but containing 1,4,4a, 5,8,8a, 9a, 10a-octahydro-9,10-diketo anthracene and nitrobenzene as additives. The characteristics and pulping results are shown in Table IV.

The two runs were then subjected to alkaline oxygen treatment. In this treatment, the pulp at a consistency of 35% by weight was treated with sodium hydroxide. Then at a consistency of 26% by weight, the alkaline pulp was treated in a pressure vessel with oxygen at a pressure of 90 pounds per square inch. In the two runs, $Mg++$ was added to the sodium hydroxide in the amount of 0.2% on pulp. The characteristics and results of the oxygen pulping stage are shown in Table IV.

In the two runs, the pulps were refined prior to measurement of kappa number and further treatment. Refining was done in one pass through a laboratory Sprout-Waldron refiner at 0.005 inch clearance.

TABLE IV

SODA OXYGEN PULPING

PULPING DATA

| Run No. | Pulp Type | Additive | % on wood | Eff. alkali % | Sulphidity % | Max. temp. ° C. | Time to temp. min. | Time at temp. min. | Pulp kappa No. | Pulp Yield % on wood |
|---|---|---|---|---|---|---|---|---|---|---|
| 1 | Soda-Oxygen | | | 15.5 | — | 170 | 90 | 90 | 82.5 | 53.8 |
| 2 | Soda-Additive-Oxygen | 1,4,4a,5,8,8a,9a,10a-Octahydro-9,10-diketo anthracene + Nitrobenzene | 0.25) 1.00) | 15.5 | — | 170 | 90 | 64 | 82.0 | 59.9 |

OXYGEN STAGE

| Run No. | NaOH % on pulp | Temp. ° C. | Time min. | Kappa No. | Yield % on pulp | Yield % on Wood | Viscosity cps |
|---|---|---|---|---|---|---|---|
| 1 | 6.6 | 120 | 30 | 27.1 | 91.0 | 48.9 | 9.4 |
| 2 | 6.6 | 120 | 30 | 27.2 | 91.4 | 54.7 | 11.9 |

What we claim is:

1. A process for the delignification of lignocellulosic material comprising the steps of:

1. treating the lignocellulosic material in a closed reation vessel with a soda pulping liquor containing from 0.001 to 10.0% by weight, based on the lignocellulosic material, of a diketo hydroanthracene selected from the group consisting of the unsubstituted and lower alkyl-substituted Diels Alder adducts of naphthoquinone and benzoqunione, and from 0.01 to 10.0% by weight, based on lignocellulosic material, of a nitro aromatic compound selected from the group consisting of mono- and dinitrobenzenes and the amino, carboxy, hydroxy and methyl derivatives of said nitrobenzenes, the treatment taking place at a temperature in the range of 150° to 200° C. for a period of 0.5 to 480 minutes, and 2. displacing the pulping liquor from the lignocellulosic material with water or an aqueous liquor inert to the lignocellulosic material to obtain delignified lignocellulosic material.

2. A process as claimed in claim 1 wherein the lower alkyl-substituted Diels Alder adducts are adducts substituted with 1 to 4 alkyl groups which may be the same or different and may each contain 1 to 4 carbon atoms.

3. A process as claimed in claim 2 wherein the nitro aromatic compound is selected from the group consisting of nitrobenzene, 2-nitroaniline, 4-nitroaniline, 4-nitrobenzaledhyde, 4-nitrobenzoic acid, 2-nitroresorcinol, 4-nitrostyrene, 2-nitrotoluene, 4-nitrotoluene, 1,2-dinitrobenzene, 1,3-dinitrobenzene, 1,4-dinitrobenzene, 2,4-dinitrotoluene, 3,5-dinitrobenzoic acid, 4,6-dinitro-o-cresol and 2,4-dinitroresorcinol.

4. A process as claimed in claim 1 wherein the nitro aromatic compound is nitrobenzene and the diketo anthracene is selected from the group consisting of 1,4,4a 9a-tetrahydro-9,10-diketo hydroanthracene, 2-ethyl-1,4,4a, 9a-tetrahydro-9,10-diketo anthracene, 2,3-dimethyl-1,4,4a, 9a-tetrahydro-9,10-diketo anthracene, 1,3-dimethyl-1,4,4a-9a-tetrahydro-9,10-diketo anthracene, 1,4,4a, 5,8,8a, 9a, 10a-octahydro-9,10-diketo anthracene, 2,3,6,7-tetramethyl-1,4,4a, 5,8,8a, 9a, 10a-octahydro-9,10-diketo anthracene and a mixture of 2,6- and 2,7-diethyl-1,4,4a, 5,8,8a, 9a, 10a-octahydro-9,10-diekto anthracene.

5. A process as claimed in claim 1 wherein the pulping liquor contains from 0.01 to 1.0% by weight based on lignocellulosic material, of the diketo hydroanthracene and from 0.10 to 2.0% by weight, based on the lignocellulosic material, of the nitro aromatic compound.

6. A process as claimed in claim 1 wherein the delignified lignocellulosic material is subjected to the following additional steps:

3. treatment of the delignified lignocellulosic material in an aqueous suspension at a consistency of from 2 to 40% by weight for from 0.5 to 60 minutes at from 20° to 90° C. with from 2 to 20% by weight of an alkali metal base and
4. treatment of the alkali metal base treated material in an aqueous medium at a consistency of from 3to 40% by weight with oxygen or an oxygen-containing gas for from 0.5 to 120 minutes at a temperature of from 80° to 150° C. and a partial pressure of oxygen of from 20 to 200 pounds per square inch.

7. A process as claimed in claim 6 wherein the oxygen-treated material is subjected to conventional bleaching.

8. A process as claimed in claim 1 wherein the delignified lignocellulosic material is subjected to conventional bleaching.

* * * * *